United States Patent [19]

Brenner et al.

[11] Patent Number: 5,042,099

[45] Date of Patent: Aug. 27, 1991

[54] BED SHEET SYSTEM

[75] Inventors: Claire Brenner, Carmel Valley, Calif.; Donna Bernstein; Alex Bernstein, both of Sea Cliff, N.Y.

[73] Assignee: Heirloom Creations, Inc., Sea Cliff, N.Y.

[21] Appl. No.: 521,112

[22] Filed: May 2, 1990

[51] Int. Cl.[5] ..... A47G 9/04

[52] U.S. Cl. ..... 5/502; 5/484; 5/493; 5/496; 5/499; 5/500

[58] Field of Search ..... 5/484, 493-500, 5/502

[56] References Cited

U.S. PATENT DOCUMENTS

| | | | |
|---|---|---|---|
| 2,567,072 | 4/1951 | Kay | 5/484 |
| 3,066,321 | 12/1962 | Kintner | 5/498 |
| 3,286,284 | 11/1966 | Klogether et al. | 5/484 X |
| 3,530,487 | 9/1970 | Beer | 5/494 X |
| 3,832,743 | 9/1974 | Smith | 5/496 |
| 3,879,777 | 4/1975 | Walker | 5/500 |
| 3,965,504 | 7/1976 | Ainsworth | 5/496 |
| 4,386,439 | 6/1983 | Roccograndi et al. | 5/493 X |
| 4,899,408 | 2/1970 | Illingworth | 5/484 |
| 4,922,565 | 5/1990 | Blake | 5/484 |

*Primary Examiner*—Michael F. Trettel

*Attorney, Agent, or Firm*—Ostrolenk, Faber, Gerb & Soffen

[57] ABSTRACT

A bed sheet system which includes a mattress cover, a bottom sheet and a protective panel. The components of the system are releasably securable to each other so that they can be conveniently removed, washed and replaced.

28 Claims, 4 Drawing Sheets

BED SHEET SYSTEM

BACKGROUND OF THE INVENTION

Conventional covers for a crib, a hospital bed, a waterbed, and the like must be frequently removed, washed and then tucked back in place. This has been a cumbersome and inconvenient procedure, particularly in connection with a crib with vertical restraining bars or supports along its sides and a mattress which fits fairly tightly between the bars. The tight fit between the mattress and the bars makes it difficult to tuck conventional covers in place.

Allison, U.S. Pat. No. 3,570,026, addresses this problem by using a panel which can be separately removed and replaced. But the panel is essentially as long as the mattress and is therefore difficult to handle. Since the location at which a bed will be soiled can often be predicted, it is more convenient to use a shorter panel which can be positioned at a desired location along the length of the mattress.

Ferolito, U.S. Pat. No. 2,982,976, and Yancofski, U.S. Pat. No. 2,614,273, disclose examples of such short protective panels. But, to secure Ferolito's panel in place, a complicated and inconvenient arrangement is required. Additionally, Ferolito's panel cannot be conveniently used with a bottom sheet. Yancofski's panel is not secured in place at all.

Further, in the prior art, dust ruffles are conventionally supported between a mattress and a set of springs or the like. The dust ruffle must be assembled beneath the mattress and the mattress must then be covered by a separate mattress cover. This is a cumbersome and inconvenient arrangement.

SUMMARY OF THE INVENTION

The present invention relates to a sheet system the components of which can be conveniently removed, washed and replaced. Preferably, the system includes a bottom sheet which does not have to be tucked into place. Preferably, the sheet system includes a dust ruffle which is conveniently formed as a part of a mattress cover.

In particular, the present invention relates to a sheet system which includes: (A) a mattress cover with a top main portion for covering a top surface of a mattress, the top main portion of the mattress cover including fastening means; (B) a protective panel for protecting the mattress cover, the protective panel being as wide as but shorter than the top main portion of the mattress cover, the protective panel including first fastening means for releasably securing the protective panel to the fastening means of the top main portion of the mattress cover at a desired location, the protective panel also including second fastening means; and (C) a bottom sheet for covering the mattress cover and the protective panel, the bottom sheet being as wide as and as long as the top main portion of the mattress cover, the bottom sheet including first fastening means for releasably securing the bottom sheet to the second fastening means of the protective panel and to the fastening means of the top main portion of the mattress cover. The bottom sheet will be referred to herein sometimes as the "tuckless sheet".

The present invention also relates to a sheet system which includes: (A) a mattress cover which includes: (a) a top main portion for covering a top surface of a mattress, the top main portion including fastening means; and (b) sides for fitting around the mattress, the sides of the mattress cover, optionally including fastening means; (B) a bottom sheet for covering the mattress cover, the bottom sheet being as wide as and as long as the top main portion of the mattress cover, the bottom sheet including first fastening means for releasably securing the bottom sheet to the fastening means of the top main portion of the mattress cover; and (C) a protective panel for protecting the mattress cover and the bottom sheet, the protective panel being shorter than the top main portion of the mattress cover, the protective panel including fastening means for releasably securing the protective panel to the fastening means of the sides of the mattress cover.

BRIEF DESCRIPTION OF THE DRAWINGS

For the purpose of illustrating the present invention, there is shown in the drawings a form which is presently preferred, it being understood, however, that the invention is not limited to the precise arrangement and instrumentality shown.

DETAILED DESCRIPTION OF THE PREFERRED EMBODIMENTS

Figure 1:
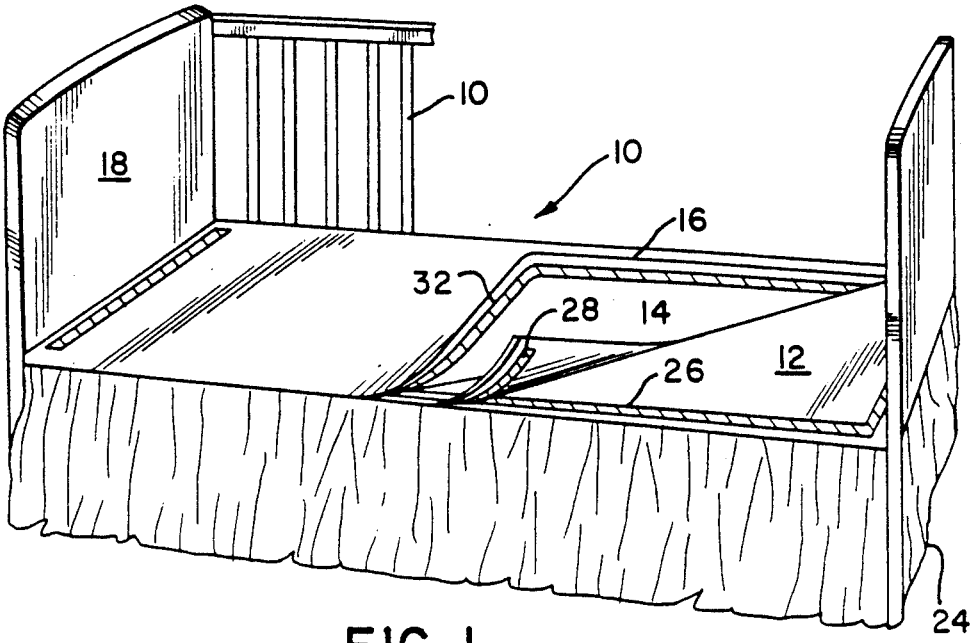
FIG. 1 is a partial perspective view of a bed sheet system in accordance with the invention.

Referring now to the drawings, wherein like reference numerals indicate like elements, there is shown in FIGS. 1-5 a sheet system which is constructed in accordance with the principles of the present invention and designated generally as 10. The sheet system 10 includes a mattress cover 12, a short waterproof panel 14 for protecting the mattress cover 12 and a bottom sheet 16 for covering the cover 12 and the panel 14.

While the sheet system 10 can be used to advantage with all sorts of beds, including twin, full, queen and king beds, hospital beds, geriatric care beds, futons and waterbeds, the sheet system 10 is described herein in connection with a conventional crib 18 for an infant.

The crib 18 (portions of which, including the front retaining bars, are not illustrated) is conventionally constructed with vertical restraining bars 20 on both sides. A rectangular mattress is supported above the floor on a set of springs or the like and fits fairly tightly between the bars 20.

Figure 2:
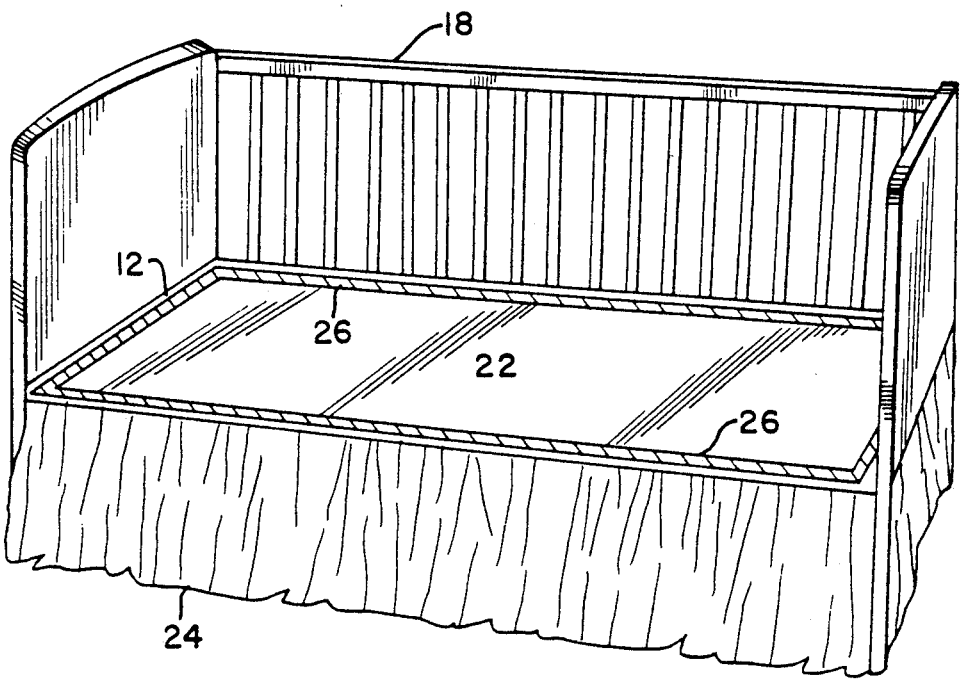
FIG. 2 is a partial perspective view of the bed sheet system of FIG. 1, in a preliminary stage of assembly.

As illustrated in FIG. 2, the mattress cover 12 includes a rectangular top main portion 22 and optionally a dust ruffle 24. The top main portion 22 is preferably formed of a conventional quilted absorbent or waterproof material which provides padding and which protects the mattress from being soiled. The width and length of the top main portion 22 are preferably the same as the width and length of the top surface of the mattress.

The dust ruffle 24 is preferably formed of four separate pieces of decorative cloth each of which is connected to a respective edge of the top main portion 22. The dust ruffle 24 should be long enough to reach all the way from the top of the mattress to the floor. Thus, the mattress cover 12 provides a convenient, one-piece means for padding and protecting the mattress and for decorating the sides of the crib 18.

The mattress cover 12 has a fastening strip 26 which is secured to and extends uniformly around the entire periphery of the top main portion 22. As explained below, the fastening strip 26 is used to releasably secure the protective panel 14 and the tuckless, bottom sheet 16 to the mattress cover 12.

Figure 3:
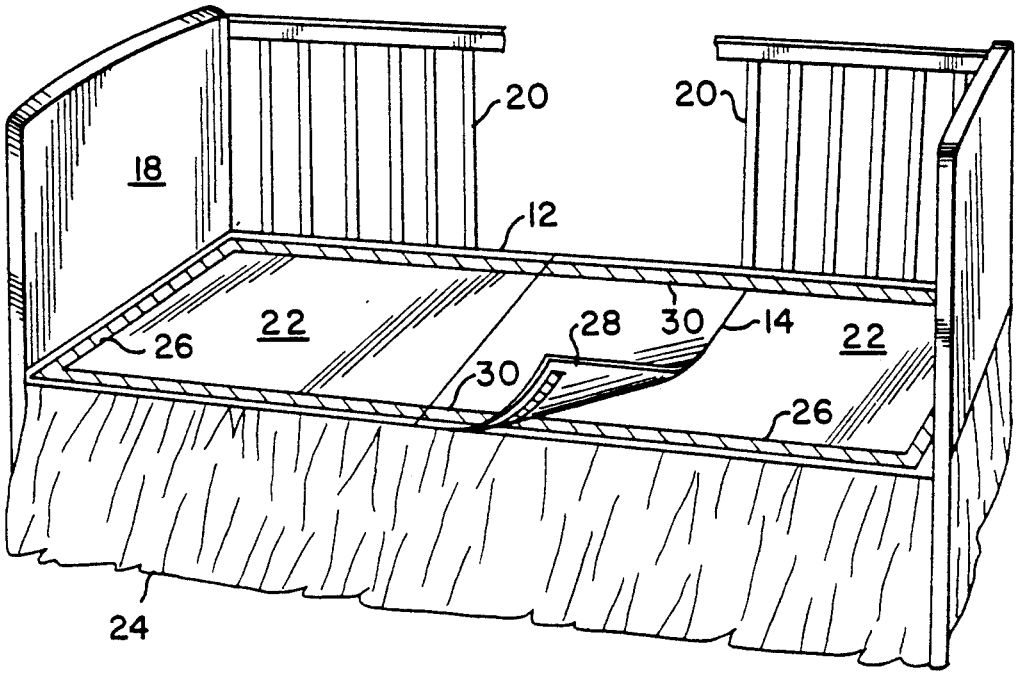
FIG. 3 is a partial perspective view of the bed sheet system of FIG. 1, in another stage of assembly.

As illustrated in FIG. 3, the waterproof panel 14 is less than half and preferably less than a third as long as the crib 18. This makes the panel 14 relatively easy to handle and clean, which is important because the panel 14 will be regularly soiled, removed and replaced.

The waterproof panel 14 has two bottom fastening strips 28 (only one of which can be seen in the drawings) which are releasably securable to the fastening strip 26. The fastening strips 28 extend the full length of the panel 14. The protective panel 14 also has top fastening strips 30 which, as explained below, are used to releasably secure the bottom sheet 16 to the panel 14. The fastening strips 30 are directly above the bottom strips 28 and extend the full length of the panel 14.

The bottom sheet 16, which covers the cover 12 and the panel 14 as illustrated in FIG. 1, is preferably no wider than and no longer than the mattress. Thus, the bottom sheet 16 does not have to be tucked into place between the mattress and the vertical restraining bars 20. Preferably, the width and length of the bottom sheet 16 is the same as the width and length of the mattress and the top main portion 22.

A fastening strip 32 (FIG. 1) is secured to the bottom of the bottom sheet 16. The fastening strip 32 extends uniformly around the entire periphery of the bottom sheet 16 and is releasably securable to the fastening strips 26 and 30.

To assemble the sheet system 10, the top main portion 22 of the mattress cover 12 is placed over the mattress and the dust ruffle 24 is tucked between the mattress and the restraining bars 20. When the mattress cover 12 is in place, the dust ruffle 24 reaches the floor and the fastening strip 26 is located on top of the mattress, along the periphery of the mattress. The mattress cover 12 will be changed only occasionally.

The short waterproof panel 14 is then placed on top of the mattress cover 12 to protect the mattress cover 12 from being soiled. The fastening strips 28 are aligned with and pressed onto opposed portions of the fastening strip 26 to hold the panel 14 in place. Since the strip 26 extends around the entire periphery of the mattress, the protective panel 14 can be positioned in any area where the bed is likely to be soiled, e.g., wherever the infant normally sleeps.

The tuckless, bottom sheet 16 is then placed on top of the cover 12 and the panel 14. The fastening strip 32 is aligned with and pressed onto the fastening strip 26 and, in the vicinity of the panel 14, aligned with and pressed onto the fastening strips 30 to hold the bottom sheet 16 in place. The bottom sheet 16 is preferably no wider than and no longer than the mattress or the mattress cover 12. Thus, the bottom sheet 16 does not have to be tucked into place.

Figure 4:
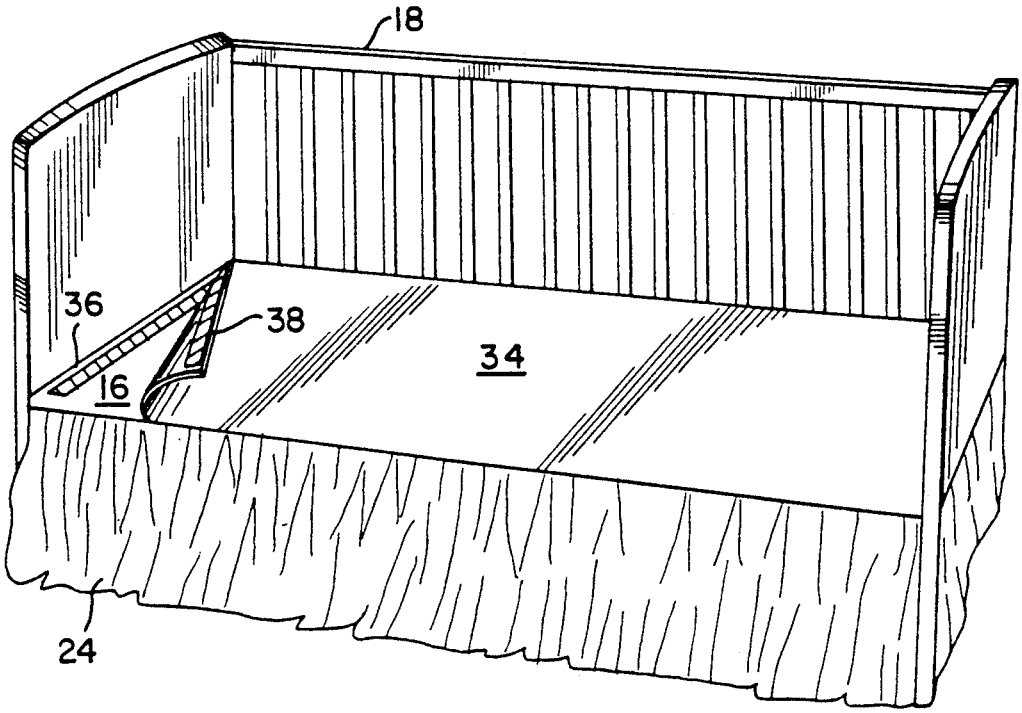
FIG. 4 is a partial perspective view of the bed sheet system of FIG. 1, in an advanced stage of assembly.

As illustrated in FIG. 4, a decorative, e.g., quilted, top sheet 34 for covering the infant is then placed on top of the bottom sheet 16. The top sheet 34, like the bottom sheet 16, does not have to be tucked into place. To keep the top sheet 34 from being pulled off the infant, the sheets 16 and 34 have fastening strips 36 and 38 which are releasably securable to each other. The fastening strips 36 and 38 are located only at the foot of the crib 18.

Since the fastening strips 26, 28, 30, 32 36 and 38 are releasably securable to each other, the top sheet 34, the bottom sheet 16 and/or the short panel 14 can be easily removed from the crib 18, washed and replaced.

Preferably, the fastening strips 26, 28, 30, 32, 36 and 38 are formed of matable hook and loop type fastening material (e.g., VELCRO brand fastener). For example, the strips 26, 30 and 36 may be formed of hook type fastening material and the strips 28, 32 and 38 may be formed of matable loop type fastening material. The strips are preferably slender (e.g., about 1 inch or 2.5 centimeters wide) and located close to the edges of the respective components of the sheet system 10.

If desired, a decorative crib quilt (not illustrated) may be placed over the top sheet 34. The quilt may fit under a quilted fold (not illustrated) at the head of the top sheet 34. Bumper sections (not illustrated) may also be provided along the interior sides of the crib 18. The entire construction is aesthetically designed and color coordinated.

Figure 5:
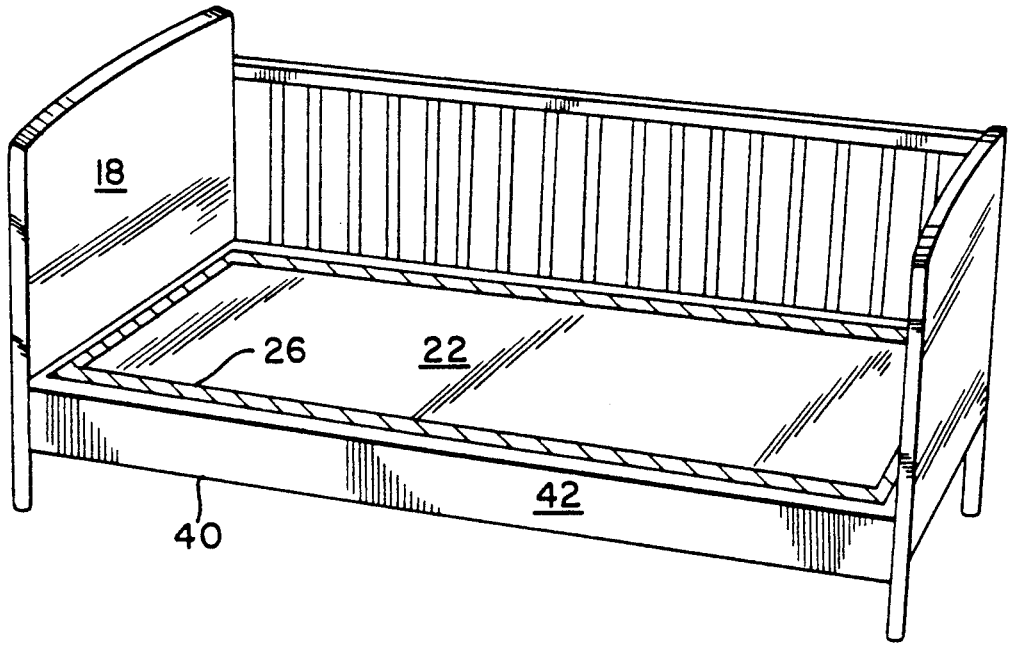
FIG. 5 is a partial perspective view of another bed sheet system in accordance with the invention.

In the foregoing embodiment, as well as the embodiment of FIG. 5 described below, the protective panel 14 is placed over the mattress cover 12 and under the bottom sheet 16. In many applications, however, it is desirable to place the protective panel 14 above the bottom sheet 16 and below the top sheet 34. In such cases, fastening strips which mate with the fastening strips 28 on the protective cover 14 will be placed along the top peripheral edges of the bottom sheet 16.

In an alternative embodiment, the mattress cover 12 is replaced by a mattress cover 40 (FIG. 5) with conventional fitted sides 42. Optionally, elastic material may be included within the sides 42 to grip tightly around the sides of the mattress and aid in holding the top main portion 22 of the fitted mattress cover 40 on the top surface of the mattress. The mattress cover 40 does not have a dust ruffle but is otherwise the same as the mattress cover 12.

Figure 6:
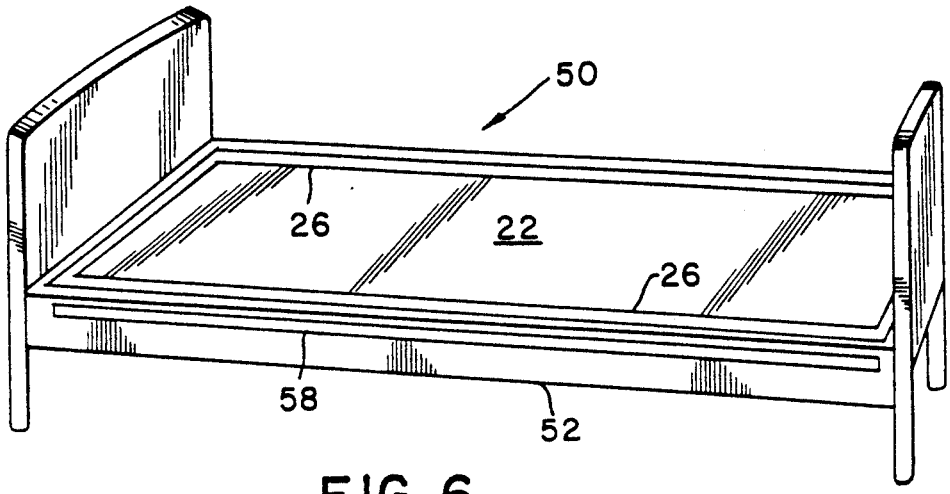
FIG. 6 is a partial perspective view of another bed sheet system in accordance with the invention.
Figure 7:
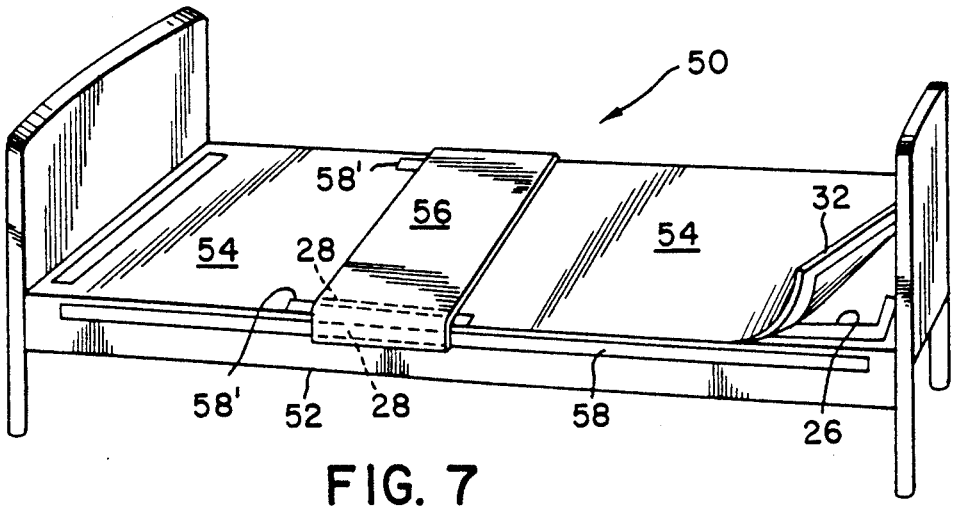
FIG. 7 is a partial perspective view of the bed sheet system of FIG. 6, in an advanced stage of assembly.

FIGS. 6 and 7 illustrate another sheet system which is constructed in accordance with the principles of the present invention and designated generally as 50. The sheet system 50 includes a fitted mattress cover 52, a bottom sheet 54 (FIG. 7) for covering the cover 52 and a short waterproof panel 56 for protecting the mattress cover 52 and the bottom sheet 54.

The mattress cover 52 has fastening strips 58 along both of its opposite fitted sides. The strips 58 are preferably about 2 to 3 inches (about 5 to 7 centimeters) below the top surface of the mattress. The fastening strips 58 optionally extend uniformly along the full length of the mattress. The mattress cover 52 is otherwise identical to the mattress cover 40 illustrated in FIG. 5. For example, in addition to the strips 58, the mattress cover 52 has a top main portion 22 (FIG. 6) and a fastening strip 26 which extends uniformly around the entire periphery of the top main portion 22.

The bottom sheet 54 is identical to the bottom sheet 16 illustrated in FIG. 1. For example, the bottom sheet 54 has a fastening strip 32 along its bottom periphery which is releasably securable to the fastening strip 26. The bottom sheet 54 also has a fastening strip 36 for securing a top sheet to the bottom sheet 54.

To assemble the sheet system 50, the bottom sheet 54 is placed on top of the mattress cover 52 and the fastening strip 32 is releasably secured to the fastening strip 26.

The short panel 56 is placed on top of and extends over the side edges of the bottom sheet 54. The panel 56 is wider than the panel 14 and the panel 56 has only bottom fastening strips 28. The panel 56 does not have fastening strips on its top surface. The panels 56 and 14 are otherwise identical. The fastening strips 28 are releasably secured to opposed portions of the strips 58 at a desired location along the fitted sides of the mattress cover 52 to hold the protective panel 56 in place. The placement of the panel 56 might serve to stabilize the mattress cover 52 and the bottom sheet 54.

However, alternatively the short panel 56 may have fastening strips 28' which are securable to fastening strips 58' which are located on the top near the edges of the bottom sheet 54. Of course, the short panel 56 need not extend over the sides of the mattress in this embodiment and obviously the strips 58 could be omitted.

Preferably, the material of the strips 26, 28, 32, 36 and 58 are chosen so that the strips 26 and 58 are releasably securable to the strips 28 and 32, but not to each other. For example, the strips 26 and 58 may be made of hook type fastening material and the strips 28, 32 and 36 of matable loop type fastening material. This makes the sheet system 50 particularly advantageous for use within a large institution, such as a hospital. A large number of the mattress covers 52 can be washed together without becoming secured to each other. Similarly, a large number of the bottom sheets 54 and the panels 56 may be washed together without becoming secured to each other.

Further, when the sheet system is used in a hospital environment, the protective panel 56 can also serve as a draw sheet for lifting and moving a patient.

Although the present invention has been described in relation to particular embodiments thereof, many variations and modifications and other uses will become apparent to those skilled in the art. It is preferred, therefore, that the present invention be limited not by the specific disclosure therein, but only by the appended claims.

What is claimed is:

1. A sheet system, comprising:

a mattress cover with a top main portion for covering a top surface of a mattress, the top main portion of the mattress cover including first fastening means;

a protective panel for protecting the mattress cover, the protective panel including second fastening means for releasably securing the protective panel to the first fastening means of the top main portion of the mattress cover at a desired location, the protective panel also including third fastening means; and a bottom sheet for covering the mattress cover and the protective panel, the bottom sheet being as wide as and as long as the top main portion of the mattress cover, the bottom sheet including fourth fastening means for releasably securing the bottom sheet to the third fastening means of the protective panel.

2. The sheet system of claim 1, wherein the protective panel is as wide as but shorter than the top main portion of the mattress cover.

3. The sheet system of claim 2, wherein the bottom sheet is not substantially wider than and not substantially longer than the top main portion of the mattress cover so that the bottom sheet does not have to be tucked into place.

4. The sheet system of claim 2, wherein the mattress cover includes a dust ruffle, the dust ruffle being connected to the top main portion of the mattress cover.

5. The sheet system of claim 2, wherein the mattress cover includes fitted sides for securing the top main portion of the mattress cover to the mattress.

6. The sheet system of claim 2, wherein the protective panel is formed of waterproof material.

7. The sheet system of claim 2, wherein the first fastening means of the mattress cover is located along the periphery of the top main portion.

8. The sheet system of claim 7, wherein the protective panel includes side edges, the second fastening means of the protective panel extending adjacent the side edges.

9. The sheet system of claim 8, wherein the third fastening means of the protective panel extends adjacent the side edges of the protective panel.

10. The sheet system of claim 9, wherein the fourth fastening means of the bottom sheet extends along the periphery of the bottom sheet.

11. The sheet system of claim 10, wherein the first fastening means of the mattress cover, the second and third fastening means of the protective panel and the fourth fastening means of the bottom sheet are formed of strips of releasably securable material.

12. The sheet system of claim 11, wherein the releasably securable material is hook and loop type fastening material.

13. The sheet system of claim 1, further comprising a top sheet, the bottom sheet including fifth fastening means at an end thereof, the top sheet including sixth fastening means at an end thereof for releasably securing the top sheet to the fifth fastening means of the bottom sheet.

14. A bed sheet system, comprising:

a bed with a mattress, the mattress having a top surface;

a mattress cover with a top main portion which covers the top surface of the mattress and the sides of the mattress;

a protective panel for protecting the mattress cover, the protective panel being as wide as but shorter than the top surface of the mattress, the protective panel being releasably secured to the top main portion of the mattress cover at a desired location; and a bottom sheet for covering the mattress cover and the protective panel, the bottom sheet being as wide as and as long as the top surface of the mattress, the bottom sheet being on top of the protective panel, the bottom sheet being releasably secured to the protective panel and to the top main portion of the mattress cover.

15. The bed sheet system of claim 14, wherein the bed is a crib for an infant.

16. The bed sheet system of claim 14, further including a top sheet and means for releasably coupling the bottom sheet to the top sheet along one end of the top surface of the mattress.

17. A sheet system, comprising:

first fastening means and means for mounting the first fastening mean to a top surface of a mattress;

a protective panel including second fastening means for releasably securing the protective panel to the first fastening means at a desired location thereon, the protective panel also including third fastening means; and a bottom sheet for covering the protective panel and the exposed portions of the top surface of the mattress, the bottom sheet being as wide as and as long as the top surface of the mattress, the bottom sheet including fourth fastening means for releasably securing the bottom sheet to the third fastening means of the protective panel.

18. The sheet system of claim 17, wherein the means for mounting the first fastening means to the top surface of the mattress comprises a mattress cover and wherein the first fastening means are secured to the mattress cover.

19. The sheet system of claim 17, further including a top sheet and means for releasably coupling the top sheet to the bottom sheet along one end of the top surface of the mattress.

20. The sheet system of claim 17, further including means for releasably securing the bottom sheet to the exposed portions of the top surface of the mattress.

21. A bed sheet system, comprising:

a bed with a mattress, the mattress having a top surface and sides;

a mattress cover with a top main portion which covers the top surface of the mattress, the mattress cover having sides which are fitted around the sides of the mattress;

a bottom sheet for covering the mattress cover, the bottom sheet being as wide as and as long as the top main portion of the mattress cover, the bottom sheet being releasably secured to the top main portion of the mattress cover; and a protective panel for protecting the mattress cover and the bottom sheet, the protective panel being shorter than the top main portion of the mattress cover, the protective panel being releasably secured to the bottom sheet.

22. The bed sheet system of claim 21, wherein the protective panel comprises fastening strips which are secured to corresponding fastening strips located on a top surface near edges of the bottom sheet.

23. A sheet system, comprising:

a mattress cover with a top main portion which covers the top surface of a mattress, the mattress cover having sides which are fitted around the sides of the mattress;

a bottom sheet for covering the mattress cover, the bottom sheet being as wide as and as long as the top main portion of the mattress cover, the bottom sheet being releasably secured to the top main portion of the mattress cover; and a protective panel for protecting the mattress cover and the bottom sheet, the protective panel being shorter than the top main portion of the mattress cover, the protective panel being releasably secured to the bottom sheet.

24. The sheet system of claim 23, wherein the protective panel comprises fastening strips which are secured to corresponding fastening strips located on a top surface near edges of the bottom sheet.

25. The sheet system of claim 23, further including a top sheet and means for releasably coupling the top sheet to the bottom sheet along one end of the top main portion of the mattress cover.

26. A bed sheet system, comprising:

a bed with a mattress, the mattress having a top surface and sides;

first fastening means and means for mounting the first fastening means to a top surface of the mattress;

a bottom sheet for covering the top surface of the mattress, the bottom sheet being as wide as and as long as the top surface of the mattress, the bottom sheet being releasably secured to the first fastening means; and a protective panel for protecting the mattress and the bottom sheet, the protective panel being shorter than the bottom sheet and being releasably secured to the bottom sheet.

27. The bed sheet of claim 26, wherein the protective panel comprises fastening strips which are releasably coupled to corresponding fastening strips located near edges of the bottom sheet.

28. The bed sheet system of claim 26, further including a top sheet and means for releasably coupling the top sheet to the bottom sheet along one end of the top surface of the mattress.

* * * * *